US008746835B2

(12) United States Patent
Wright et al.

(10) Patent No.: US 8,746,835 B2
(45) Date of Patent: Jun. 10, 2014

(54) SYSTEM AND METHOD FOR CORRECTING STITCH AND ROLL ERROR IN A STAGGERED FULL WIDTH ARRAY PRINTHEAD ASSEMBLY

(75) Inventors: John Albert Wright, Molalla, OR (US); Stan Alan Spencer, Sherwood, OR (US); Cary Eric Sjolander, Tigard, OR (US)

(73) Assignee: Xerox Corporation, Norwalk, CT (US)

( * ) Notice: Subject to any disclaimer, the term of this patent is extended or adjusted under 35 U.S.C. 154(b) by 961 days.

(21) Appl. No.: 12/398,692

(22) Filed: Mar. 5, 2009

(65) Prior Publication Data

US 2010/0225691 A1 Sep. 9, 2010

(51) Int. Cl.

*B41J 29/393* (2006.01)
*B41J 2/045* (2006.01)
*B41J 25/00* (2006.01)

(52) U.S. Cl.

CPC ..... *B41J 2/04505* (2013.01); *B41J 29/393* (2013.01); *B41J 25/001* (2013.01)
USPC ..... 347/19; 347/14

(58) Field of Classification Search

USPC ..... 347/19
See application file for complete search history.

(56) References Cited

U.S. PATENT DOCUMENTS

| | | | | |
|---|---|---|---|---|
| 6,000,774 | A * | 12/1999 | Nambudiri | 347/7 |
| 6,213,580 | B1 | 4/2001 | Segerstrom et al. | |
| 6,561,613 | B2 | 5/2003 | Cunnagin et al. | |
| 6,688,721 | B1 | 2/2004 | Serra | |
| 6,773,086 | B2 | 8/2004 | Serra et al. | |
| 6,937,260 | B2 | 8/2005 | Williams et al. | |
| 7,052,110 | B2 | 5/2006 | Jones et al. | |
| 7,204,571 | B2 | 4/2007 | Platt et al. | |
| 7,222,934 | B2 | 5/2007 | Williams | |
| 7,309,118 | B2 | 12/2007 | Mizes et al. | |
| 2002/0041299 | A1 * | 4/2002 | Lee et al. | 347/19 |
| 2002/0126169 | A1 * | 9/2002 | Wyngaert et al. | 347/12 |
| 2003/0020776 | A1 * | 1/2003 | Franzke et al. | 347/19 |
| 2010/0013882 | A1 * | 1/2010 | Mizes et al. | 347/14 |

* cited by examiner

*Primary Examiner* — Shelby Fidler
(74) *Attorney, Agent, or Firm* — Maginot, Moore & Beck, LLP

(57) ABSTRACT

A method evaluates printhead position in a staggered full width array (SFWA) printhead assembly. The method includes selecting a first printhead configuration for printing a first test pattern on an image receiving member, generating positional correction data for roll and stitch displacements obtained from captured image data of the first test pattern, comparing the positional correction data to at least one threshold in a displacement range, and operating at least one printhead actuator in accordance with the positional correction data in response to the positional correction data exceeding at least one predetermined threshold in the displacement range.

20 Claims, 4 Drawing Sheets

SYSTEM AND METHOD FOR CORRECTING STITCH AND ROLL ERROR IN A STAGGERED FULL WIDTH ARRAY PRINTHEAD ASSEMBLY

TECHNICAL FIELD

This disclosure relates generally to imaging devices having staggered full width printhead assemblies, and more particularly, to the correction of stitch and roll errors in such imaging devices.

BACKGROUND

Some ink printing devices use a single printhead, but many use a plurality of printheads to increase the rate of printing. For example, four printheads may be arranged in two rows with each row having two printheads. The two printheads in the first row are separated by a distance corresponding to the width of a printhead. The first printhead in the second row is positioned at a location corresponding to the gap between the two printheads in the first row and the last printhead in the second row is separated from the first printhead in the second row by a distance corresponding to the width of a printhead. This arrangement is called a staggered full width array (SFWA) printhead assembly and an embodiment of a SFWA assembly is shown in FIG. 1.

Synchronizing the passage of an image receiving member with the firing of the inkjets in the printheads enables a continuous ink image to be formed across the member in the direction perpendicular to the direction of member passage. Alignment of the ink drops ejected by the printheads, however, may not be as expected. Each printhead in the SFWA has six degrees of positional freedom, three of which are translational and three of which are rotational. The printheads need to be precisely aligned to provide a smooth transition from the ink drops ejected by one printhead to the ink drops printed by the other printheads in the assembly. Misalignment of printheads may occur from, for example, printheads failing to meet manufacturing tolerances, thermal expansion of the printhead and associated parts of the printer, vibration of the printhead, or the like.

Misalignments between printheads in three of the six degrees of freedom may be categorized as roll or stitch errors. Roll errors can occur when a printhead rotates about an axis normal to the imaging member. Roll error causes a skew in the rows of ink drops ejected by the printhead relative to the imaging member. This skew may be noticeable at the interface between two printheads and may cause an objectionable streak. Stitch errors occur from shifts in one printhead compared to another printhead. Y-axis stitch errors arise from shifts that cause ink drop rows from the shifted printhead to land above or below the ink drop rows ejected by preceding or following printhead. X-axis stitch errors arise from shifts that cause the first and last drops in the rows printed by the shifted printhead to be too close or too far from the last and first drops, respectively, in the rows printed by the preceding and following printheads, respectively. Of course, if the shifted printhead is the first or last printhead in the assembly, shifting of the first drop or the last drop in the rows, respectively, does not occur at an intersection with another printhead. Thus, aligning printheads in a SFWA with sufficient accuracy to allow high image quality is desired.

SUMMARY

A method evaluates image quality in an ink printing system and generates data values for adjusting the position and orientation of printheads in a SFWA. The method includes selecting a first printhead configuration for printing a first test pattern on an image receiving member, generating positional correction data for roll and stitch displacements obtained from captured image data of the first test pattern, comparing the positional correction data to at least one threshold in a displacement range, and operating at least one printhead actuator in accordance with the positional correction data in response to the positional correction data exceeding at least one predetermined threshold in the displacement range.

The method may be implemented with a system that evaluates data generated from captured image data of test pattern images printed by a SFWA to generate positional correction data for adjusting position and orientation of printheads in the SWFA. The system includes a plurality of printheads configured to eject ink onto an image receiving member to form a first test pattern, an image evaluator configured to generate positional correction data for roll and stitch displacements detected in captured image data of the first test pattern, and a controller coupled to the plurality of printheads, the image evaluator, and at least one printhead actuator coupled to the plurality of printheads, the controller being configured to operate the at least one printhead actuator in accordance with the positional correction data in response to the positional correction data exceeding at least one predetermined threshold in a displacement range.

BRIEF DESCRIPTION OF THE DRAWINGS

The foregoing aspects and other features of a system that evaluates image quality in an ink printing system and generates data values for altering the operation of the ink printing system are explained in the following description, taken in connection with the accompanying drawings.

DETAILED DESCRIPTION

Figure 1:
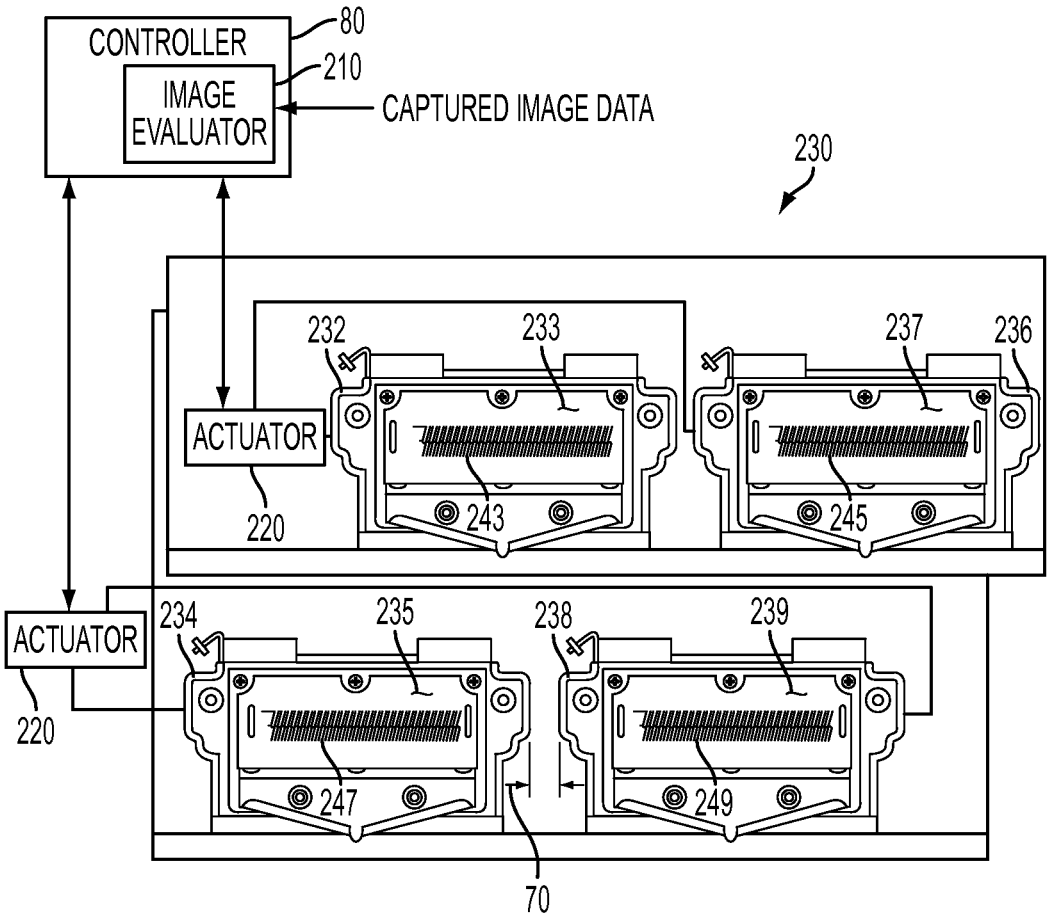
FIG. 1 is a perspective view of a staggered full width array (SFWA) printhead assembly having four printheads.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multifunction machine, or the like. Also, the description presented below is directed to a system that generates positional correction data for printhead stitch and roll errors in a SFWA printhead assembly.

Figure 4:
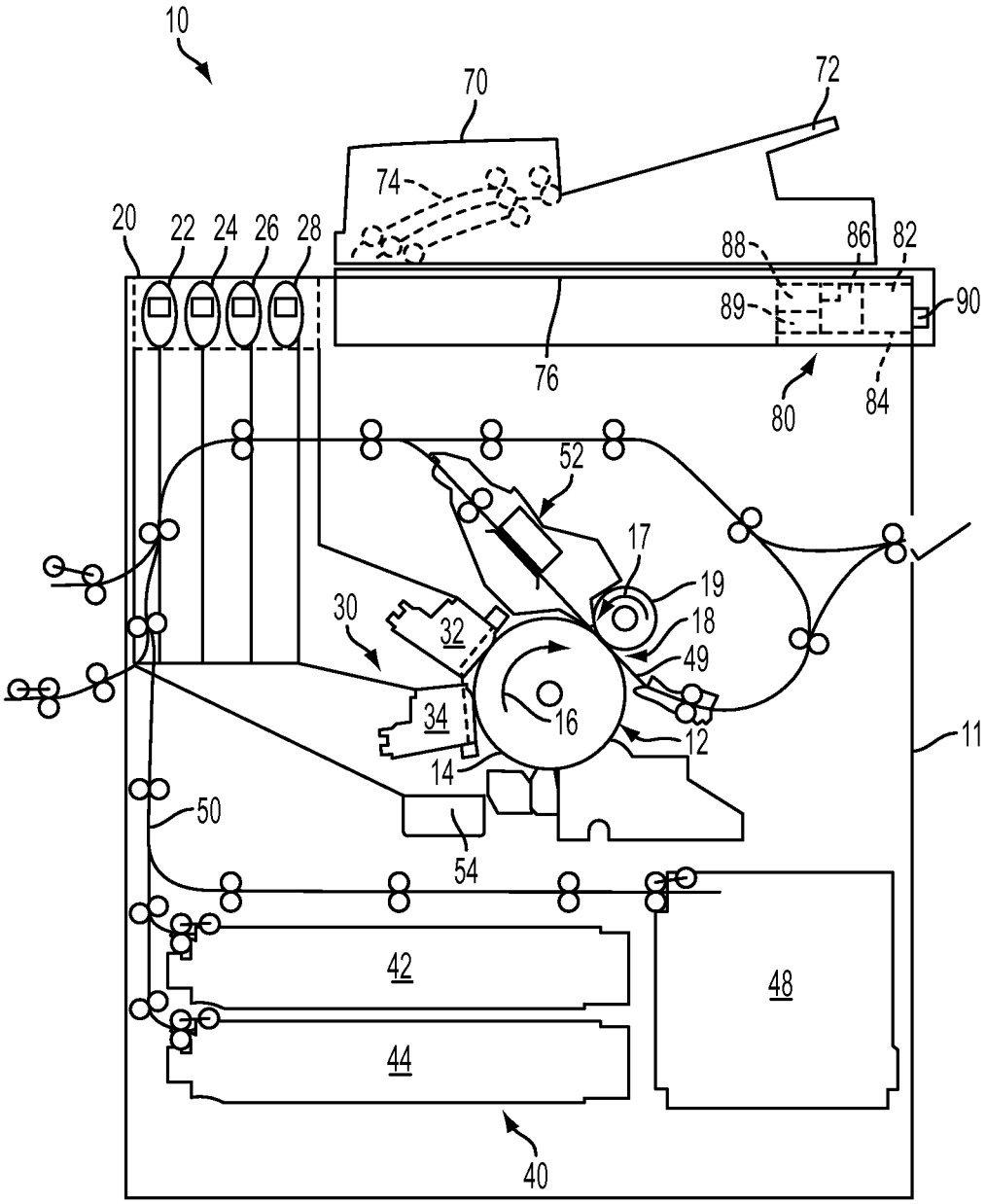
FIG. 4 is a block diagram of a printer depicting the components operated by a controller to detect errors in test patterns and generate positional correction data for adjusting the position of printheads in a SFWA printhead assembly.

Referring now to FIG. 4, an embodiment of an image producing machine, such as a high-speed phase change ink image producing machine or printer 10, is depicted. As illustrated, the machine 10 includes a frame 11 to which are mounted directly or indirectly all its operating subsystems and components, as described below. To start, the high-speed phase change ink image producing machine or printer 10 includes an imaging member 12 that is shown in the form of a drum, but can equally be in the form of a supported endless belt. The imaging member 12 has an imaging surface 14 that is movable in the direction 16, and on which phase change ink images are formed. A transfix roller 19 rotatable in the direction 17 is loaded against the surface 14 of drum 12 to form a transfix nip 18, within which ink images formed on the surface 14 are transfixed onto a heated media sheet 49.

The high-speed phase change ink image producing machine or printer 10 also includes a phase change ink delivery subsystem 20 that has at least one source 22 of one color phase change ink in solid form. Since the phase change ink image producing machine or printer 10 is a multicolor image producing machine, the ink delivery system 20 includes four (4) sources 22, 24, 26, 28, representing four (4) different colors CYMK (cyan, yellow, magenta, black) of phase change inks. The phase change ink delivery system also includes a melting and control apparatus (not shown) for melting or phase changing the solid form of the phase change ink into a liquid form. The phase change ink delivery system is suitable for supplying the liquid form to a printhead system 30 including at least one printhead assembly 32. Since the phase change ink image producing machine or printer 10 is a high-speed, or high throughput, multicolor image producing machine, the printhead system 30 includes multicolor ink printhead assemblies and a plural number (e.g., two (2)) of separate printhead assemblies 32 and 34 as shown.

As further shown, the phase change ink image producing machine or printer 10 includes a substrate supply and handling system 40. The substrate supply and handling system 40, for example, may include sheet or substrate supply sources 42, 44, 48, of which supply source 48, for example, is a high capacity paper supply or feeder for storing and supplying image receiving substrates in the form of cut sheets 49, for example. The substrate supply and handling system 40 also includes a substrate handling and treatment system 50 that has a substrate heater or pre-heater assembly 52. The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80, for example, is a self-contained, dedicated mini-computer having a central processor unit (CPU) 82 with electronic storage 84, and a display or user interface (UI) 86. The ESS or controller 80, for example, includes a sensor input and control circuit 88 as well as a pixel placement and control circuit 89. In addition, the CPU 82 reads, captures, prepares and manages the image data flow between image input sources, such as the scanning system 76, or an online or a work station connection 90, and the printhead assemblies 32 and 34. As such, the ESS or controller 80 is the main multi-tasking processor for operating and controlling all of the other machine subsystems and functions, including the printhead cleaning apparatus and method discussed below.

The controller 80 may be implemented with general or specialized programmable processors that execute programmed instructions. The instructions and data required to perform the programmed functions may be stored in memory associated with the processors or controllers. The processors, their memories, and interface circuitry configure the controllers to perform the processes, described more fully below, that enable the generation and analysis of printed test strips for the generation of firing signal waveform adjustments and digital image adjustments. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

In operation, image data for an image to be produced are sent to the controller 80 from either the scanning system 76 or via the online or work station connection 90 for processing and output to the printhead assemblies 32 and 34. Additionally, the controller determines and/or accepts related subsystem and component controls, for example, from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by any one of the sources 42, 44, 48 and handled by substrate system 50 in timed registration with image formation on the surface 14. Finally, the image is transferred from the surface 14 and fixedly fused to the image substrate within the transfix nip 18.

To evaluate the position and alignment of the printheads in a SFWA printhead assembly, the controller 80 may execute programmed instructions that enable the printer to implement a plurality of processes for generating positional correction data to address the roll and/or stitch errors, and evaluate the application of the correction data and the need to continue further error processing. In general, these processes receive captured image data of a test pattern printed on an image receiving member. The controller may implement an image evaluator that processes captured image data and enables the controller to generate positional correction data for alignment of the printheads. In one embodiment, a plurality of processes implemented by a controller 80 executing programmed instructions include an image evaluator 210 (FIG. 1) for roll and stitch error positional correction data generation, and analysis of the correction data to determine whether to apply the data to adjust the position of one or more printheads, and to determine whether additional testing is required. One implementation of these processes is discussed below.

Referring now to FIG. 1, a SFWA printhead assembly for a high-speed, or high throughput, multicolor image producing machine is shown. The assembly 230 is coupled to the controller 80 and at least one actuator 220. The assembly 230 has four printheads 232, 234, 236, and 238. The upper printheads 232 and 236 and lower printheads 234 and 238 are arranged in a staggered pattern. Each printhead 232, 234, 236, and 238 has a corresponding front face 233, 235, 237 and 239 for ejecting ink onto an image receiving member to form an image. The staggered arrangement enables the printheads to form an image across the full width of the substrate. In print mode the printhead front faces 233, 235, 237, 239 are disposed close, for example, about 23 mils, to the imaging surface 14 of the drum 12. In one embodiment, each printhead is approximately 2.5 inches long. This length enables the SFWA printhead assembly to print an image that is approximately 10 inches long in the cross-process direction. Each printhead may be coupled to one of two actuators 220. The actuators are coupled to the printheads through gear trains, translational, or rotational linkages to move the printheads. The actuators 220 respond to signals from the controller 80. A portion of the instructions executed by the controller 80 implement an image evaluator 210 that processes captured image data of test patterns to generate positional correction data for roll and stitch errors. Other processes implemented by the controller 80 convert the positional correction data to stepper motor pulses or other control signals for manipulating the actuators 220 and the printheads 232, 234, 236, and 238.

The ejecting face of each printhead 232, 234, 236, and 238 includes a plurality of nozzles 243, 247, 245, 249, respectively, that may be arranged in rows that extend in the cross-process direction (X axis) across the ejecting face. The spacing between each nozzle in a row is limited by the number of ink jets that can be placed in a given area in the printhead. To enable the printing of drops onto a receiving substrate at distances that are closer in the cross-process direction than the distance between adjacent nozzles in a row, the nozzles in one row of a printhead are offset in the cross-process direction (along the X axis) from the nozzles in at least some of the other rows in the printhead. The offset between nozzles in adjacent rows enables the number of ink drops in a printed row to be increased by actuating the inkjets in a subsequent row to eject ink as the drops ejected by a previous row arrive. Of course, other arrangements of nozzles are possible. For example, instead of having offset rows of nozzles, the nozzles may be arranged in a grid in the ejecting face with linear rows and columns of nozzles. Each printhead in an assembly may be configured to emit ink drops of each color utilized in the imaging device. In such a configuration, each printhead may include one or more rows of nozzles for each color of ink used in the imaging device. In another embodiment, each printhead may be configured to utilize one color of ink so the jets of the printhead eject the same color of ink.

As discussed above, alignment of a printhead with respect to the receiving substrate and with respect to other printheads in the imaging device may present image quality issues. One particular type of alignment parameter is printhead roll. As used herein, printhead roll refers to clockwise or counter-clockwise rotation of a printhead about an axis normal to the plane of the image receiving surface. Printhead roll may result from factors such as mechanical vibrations, and other sources of disturbances on the machine components, that may alter print head positions and/or angles with respect to an image receiving surface. These same disturbances may also cause stitch errors. Stitch errors arise when the printhead shifts in the process (Y) direction or the cross-process (X) direction. These errors result in misalignment of drops from one printhead with the drops of another printhead. In the case of Y stitch errors the drops in the rows of one printhead are shifted up or down from the drops in the rows of another printhead. In the case of X stitch errors, the spacing between the last drop of one printhead is closer to or further away from the first drop of the next printhead than the spacing between adjacent drops in a printhead.

Figure 2:
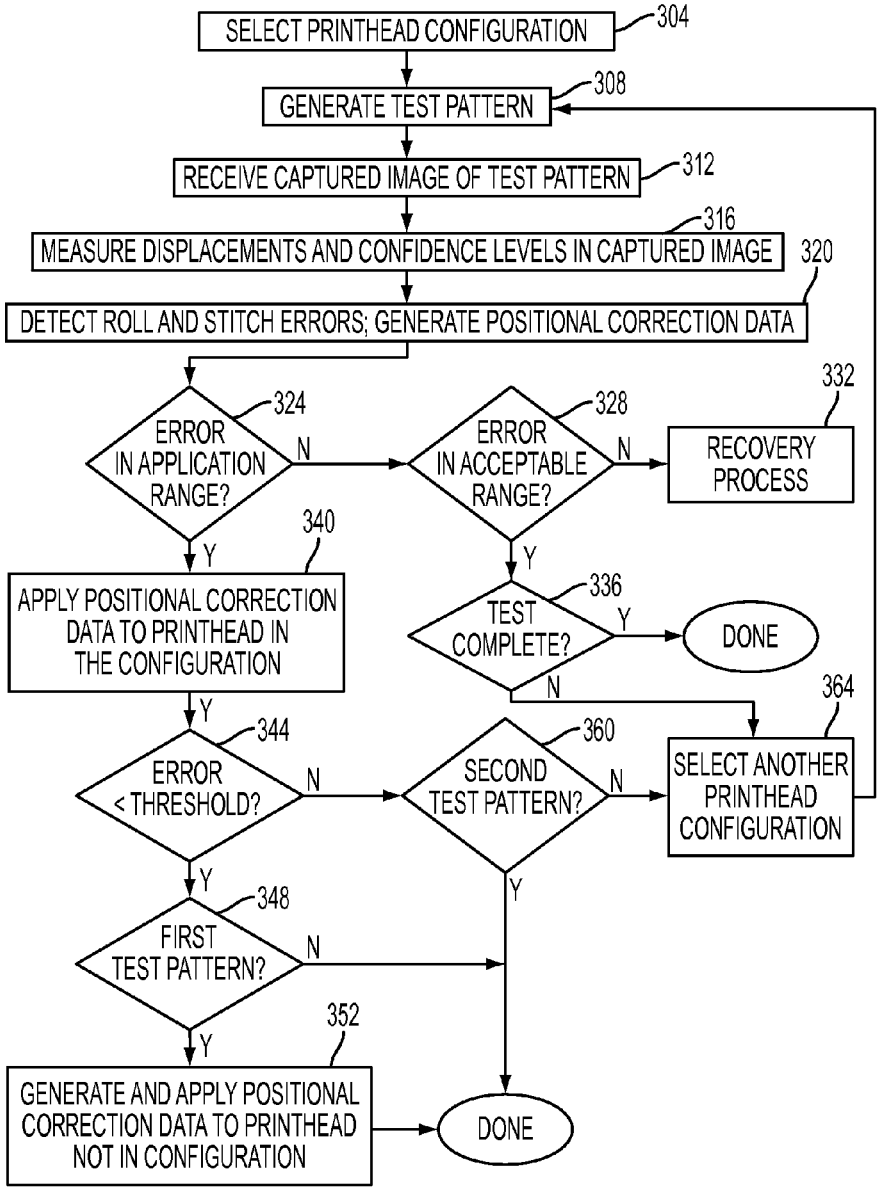
FIG. 2 is a flow diagram of a process for generating positional correction data that may be used to adjust the position of a printhead in the SFWA printhead assembly shown in FIG. 1.

A process that may be implemented by a printer controller to evaluate printhead position in a SFWA printhead assembly and generate positional correction data is shown in FIG. 2. The process 300 begins by selecting a configuration of printheads within the SFWA printhead to form a test pattern (block 304). In one embodiment, two configurations are available for a four printhead SFWA printhead assembly, such as the one shown in FIG. 1. In this embodiment, one configuration uses printheads 234 and 232 to form the test pattern and the other configuration uses printheads 232, 238, and 236 to form the test pattern. The process continues by generating a test pattern on an image receiving member (block 308). The controller generates firing signals for piezoelectric ejectors in the printheads in a known manner to control the ejection of ink onto an image receiving member to form the test pattern. An image of the test pattern on the image receiving member is captured by an imaging system and the controller receives the captured image data of the test pattern (block 312). In one embodiment, the imaging system is one or more optical sensors positioned proximate a rotating image receiving member, such as an image drum or endless belt, within the printer. In another embodiment, the imaging system is a moving light source located beneath a platen to generate image data corresponding to indicia printed on a media sheet placed on the platen. In this embodiment, the test pattern may be printed directly onto the sheet or the image may be transferred from a rotating image receiving member to the media sheet that exits from the printer. The media sheet is then placed on the platen for generation of the captured image data, which are then provided to the controller. In another embodiment, the imaging system is external to the printer, but coupled to the printer for the transmission of the captured image data to the printer. This external imaging system includes a moving light source and platen similar to the one discussed above that is integrated with the printer.

The captured image data are processed by measuring displacements in the test pattern from positions in an internal representation of the test pattern stored in the printer (block 316). These displacements and confidence levels regarding the quality of the test pattern images, described in more detail below, are used to generate positional correction data (block 320). The computations for the generation of the positional correction data are discussed in more detail below. The positional correction data are compared to at least one threshold in a displacement range to determine whether the positional correction data are greater than or less than a threshold by no more than a predetermined amount (block 324). That is, the process determines whether the correction data are within a predetermined range about a threshold and this information enables the process to determine whether the correction data are applied to the printheads in the SFWA printhead assembly. Such a range is shown in FIG. 3.

Figure 3:
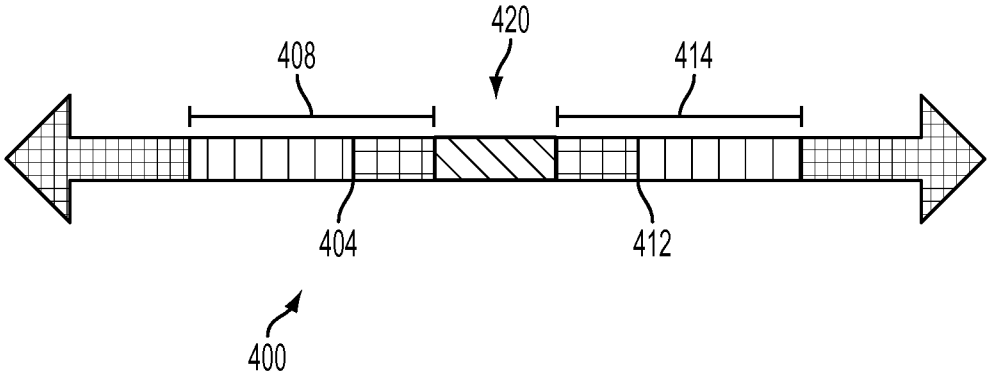
FIG. 3 is a representation of a displacement range for errors detected by the process of FIG. 2.

As shown in FIG. 3, a pair of thresholds 404 and 412 for a displacement range 400 is shown for the comparison described above. The predetermined application range 408 about threshold 404 indicates positional correction data values that are applied to printheads. Likewise, positional correction data in the range 414 about threshold 412 are also applied to the printheads. The range 420 between the application ranges 408 and 414 identify correction data values that are not applied to the printheads because the displacement errors in this portion of the range are not considered significant enough to be corrected. The portion of range 408 that is less than the threshold 404 need not be the same size as the portion of the range 408 that is greater than the threshold 404. Likewise, the portion of range 414 that is less than the threshold 412 need not be the same size as the portion of the range 414 that is greater than the threshold 412. The significance of the thresholds in the application ranges is discussed in more detail below.

If the positional correction data are not within the application range, the process (FIG. 2) determines whether the correction data are in the acceptable range 420 (block 328). If the data are not within the acceptable range, then the printheads are too far out of position for the process to correct their positions and a recovery process, which may include operator intervention, is performed (block 332). The recovery process is designed to handle large misalignments that do not occur under normal operating circumstances. If the correction data are within the acceptable range, the process tests whether the test is complete (block 336), and if it is, the process is done.

Test completion determines whether additional test patterns need to be printed and evaluated. For example, the printer may print and evaluate all printhead configurations at a system reset or the like. If a test is not complete, another printhead configuration is selected (block 364) and the process continues by printing another pattern and evaluating the pattern for errors.

If the positional correction data are within one of the application ranges (block 324), then the correction data are applied to at least one printhead in the configuration used to print the test pattern (block 340). The correction data are applied to a printhead by the controller activating at least one actuator coupled to the printheads within the SFWA printhead assembly. The controller, for example, may generate pulses to a stepper motor or the like to move a printhead in an appropriate direction to correct the detected error. The pulses are generated with reference to the positional correction data. These actuators, such as the actuators 220 in FIG. 1, are positioned proximate the SFWA printhead assembly and coupled to the printheads through a gear train or the like for translational and rotational movement of the printheads. Other ways of operating one or more actuators to move the printheads in accordance with the positional correction data may be used as well. The process then compares the correction data to the threshold in the application range to determine whether the detected error was less than the threshold (block 344). If the data are less than the threshold and the test pattern being evaluated is the first one printed (block 348), then the process also generates and applies positional correction data for a printhead that did not eject ink to form the test pattern (block 352). This adjustment is made although no test pattern was generated with the printhead because the error in the printhead(s) that generated the test pattern does not appear to be large. If the test pattern being evaluated was not the first one generated (block 348), then an additional test pattern has been printed and evaluated so the testing is finished.

If the error was greater than one of the thresholds in the application ranges (block 344), the process determines if the second test pattern is being evaluated (block 360). If the second pattern has been evaluated, then no further tested is needed. Otherwise, another printhead configuration is selected (block 364) and used to generate another test pattern (block 308). This pattern is evaluated (blocks 312-360). If the errors produced by the printheads generating the second test pattern are too large, the recovery process is activated (block 332). If the errors are in the application ranges, the positional data are applied (block 340) and the test is finished. Otherwise, the errors were in the acceptable range (block 328) and the test is complete. Thus, the portions of the application ranges that are no more than a predetermined amount above the thresholds are used to determine whether a test of one printhead configuration is sufficient to evaluate positional errors in the SFWA printhead assembly.

The computations of the positional correction data are now discussed with reference to the following table.

| | thisPos | Front | | | | | |
|---|---|---|---|---|---|---|---|
| Inputs | thisCycle | 1 of 1 | 1 of 1 | 2 of 2 | 1 of 2 | Recover | Fiducial |
| Outputs | dR1 | −mR1 | | | | | 0 |
| | dR2 | 0 | 0 | 0 | 0 | 0 | 0 |
| | dR3 | 0 | 0 | 0 | 0 | 0 | 0 |
| | dR4 | 0 | 0 | 0 | 0 | 0 | 0 |
| | dY1 | −mY1 + B * cR1 | | | | | 0 |
| | dY2 | 0 | 0 | 0 | 0 | 0 | 0 |
| | dY4 | 0 | 0 | 0 | 0 | 0 | 0 |
| | dX1 | 0 | mX1 | | | 0 | 0 |
| | dX2 | 0 | 0 | 0 | 0 | 0 | 0 |
| | dX4 | (mX2 − mX1)/2 | 0 | 0 | 0 | 0 | 0 |
| | NextPos | Rear | Rear | Rear | Rear | — | — |
| | NextCycle | Done | Done | Done | 2 of 2 | Recovery | Recovery |

| | thisPos | Rear | | | | | |
|---|---|---|---|---|---|---|---|
| Inputs | thisCycle | 1 of 1 | 1 of 1 | 2 of 2 | 1 of 2 | Recover | Fiducial |
| Outputs | dR1 | 0 | 0 | 0 | 0 | 0 | 0 |
| | dR2 | −mR2 | | | | | 0 |
| | dR3 | −mR3 | | | | | 0 |
| | dR4 | −mR4 | | | | | 0 |
| | dY1 | cY2 − A * cR2 | | | 0 | 0 | 0 |
| | dY2 | −mY2 + B * cR2 − A * cR3 | | | | | 0 |
| | dY4 | mY3 − B * cR3 + A * cR4 | | | | | 0 |
| | dX1 | 0 | cX2 + cX4 | | 0 | 0 | 0 |
| | dX2 | 0 | | | mX2 − cX4 | | |
| | dX4 | (mX2 − mX3)/2 | | | −mX3 | | |
| | NextPos | Front | Front | Front | Front | — | — |
| | NextCycle | Done | Done | Done | 2 of 2 | Recovery | Recovery |

In the table, "front" and "back" refer to the two configurations of printheads used to print test patterns with reference to the front of the imaging machine in FIG. 4, which is where an operator typically stands, and to the back of the machine, which typically faces a wall. The printheads 232 and 234 in FIG. 1 are closest to the front of the machine and printheads 236 and 238 are closest to the back of the machine. Thus, the "front" configuration uses the two "front" printheads 232 and 234 to print the test patterns, and may use printhead 238 as well, and the "back configuration" uses printheads 232, 236, and 238, in one embodiment, to print the test patterns. If the errors detected from a test pattern printed by the front configuration are within a range that indicates positional correction data are to be applied, these data are applied to adjust the position of printhead 234 only. If the errors detected from a test pattern printed by the back configuration are within a range that indicates positional correction data are to be applied, these data are applied to adjust the position of printheads 232 and 236. An evaluation of printhead positions may commence with a test pattern printed by either the front configuration or the back configuration. The column "1 of 2" indicates the adjustments to make whenever the front or the back configuration is used first. If the detected errors are greater than the threshold by the predetermined amount discussed above, the other configuration is used to print a second test pattern. The column "2 of 2" indicates the adjustments to make whenever the front or the back configuration is used to generate the second test pattern. The column "1 of 1" indicates the adjustments made whenever the front or the back configuration is used to generate the first test pattern and the errors are less than the thresholds by no more than a predetermined amount as discussed above.

With further reference to the table, the numbers 1, 2, 3, and 4 refer to the printheads in one embodiment of a SFWA printhead assembly. For example, the printheads 232, 234, 236, and 238 correspond to the numbers 2, 1, 4, and 3, respectively. The letters X and Y refer to the cross-process and process directions, respectively. The letter R refers to roll error in a printhead. Roll error is rotational movement of the printhead about the axis that is normal to the X-Y plane. The letters "m", "d", and "c" refer to measured error, positional correction data as determined by a formula in the table, and the actual applied positional correction data, respectively. For example, the measured error may lie within the range 404 discussed above. Consequently, the positional correction data determined by the formula are not applied so the actual applied positional correction data are zero.

In the table, mR1, mR2, mR3, and mR4 refer to the measured roll error for the first, second, third, and fourth printheads, respectively, in a SFWA printhead assembly. The terms mY1, mY2, and mY3 refer to the measured process direction error between the printheads for the first, second, and third stitch interfaces in a SFWA printhead assembly and mX1, mX2, and mX3 refer to the measured cross-process direction error between the printheads for the first, second, and third stitch interfaces in a SFWA printhead assembly. Thus, mY1 refers to the relative stitch spacing error between the first and second printheads in the process direction and mX1 refers to the relative stitch spacing error between the first and the second printheads in the cross-process direction. Similarly, mY2 refers to the process direction stitch spacing error between printheads 2 and 3 while mX2 refers to the cross-process direction stitch spacing error between printheads 2 and 3. Stitch interfaces are discussed in more detail below.

In one embodiment, the process that performs the analysis of the test pattern images to generate correction data for errors between printheads in a stitch interface or to correct the roll errors for a printhead, also evaluates the position of the leftmost and rightmost inkjet position in a test pattern as well as the quality of the roll test patterns by comparing the test patterns in image data of an image substrate with an internal representation of the test pattern. This analysis yields confidence level measurements that enable a process implementing the tables above to determine whether the roll and stitch displacement measurements are reliable for further processing. If the confidence levels do not meet or exceed a predetermined threshold, the measurements mR1, mR2, mR3, mR4, mY1, mY2, mY3, mX1, mX2, and mX3 are ignored. Otherwise, the measurements are processed as detailed in the tables above. The coefficients A and B in the tables above are weighting factors for applying roll error to stitch computations. In one embodiment, the A coefficient is 9.70 and the B coefficient is 83.9.

With this information, the table may be used to implement the process described above. For example, if the first printhead configuration is used to print a test pattern, the upper portion of the table is used since thisPos refers to the printhead configuration for a test pattern printing and its value is "front" for the upper portion. If the confidence level for a roll displacement is less than a predetermined threshold, the correctional positional data for the roll displacement is computed. For cross-direction stitch displacement, the confidence levels for the left and right inkjet positions in the cross-process direction at the stitch interface must be less than a predetermined threshold and the roll displacement for both printheads must be less than a roll displacement limit. If all of these conditions are met, the cross-process stitch displacement correction positional data are computed. Likewise, the process stitch displacement correction positional data are computed if the confidence levels for the left and right inkjet positions in the process direction at the stitch interface are less than a predetermined threshold and the roll displacement for both printheads are less than a roll displacement limit. The correction data in one embodiment are calculated in accordance with the tables above if the conditions explained above are met. For example, the determined positional correction data for operating the actuator that moves the first printhead to correct roll in the front test is −mR1 and the determined positional correction data for the actuator that moves the first printhead to correct process direction translation is −mY1+B*cR1. If the conditions for evaluating only the first test pattern are met, the determined positional correction data for the fourth printhead are (mX2−mX1)/2. If the conditions for printing the second test pattern are met, the positional correction data for the first printhead are mX1. After the positional correction data are calculated, the process compares the calculated data to the displacement range to determine whether the correction data are within one of the application ranges. If they are, the data are applied to the corresponding actuator. Otherwise, the correction data are not applied.

In operation, the controller of a printing system is configured with programmed instructions for implementing the roll and stitch positional displacement correction data adjustment processes. During the life of the imaging system, the controller selects and operates the processes in accordance with a schedule or as they are activated manually. The processes select printhead configurations and generate test patterns. Captured image data of the test patterns are evaluated, roll and stitch positional correction data are generated, and sometimes applied to the printheads for adjusting their positions. If the errors are too significant for correction by manipulating the actuators coupled to the printheads, a warning message/light/announcement is generated to alert an operator to the need for positional adjustment of the printheads.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for evaluating printhead position in an ink printing system comprising:

selecting a first printhead configuration for printing a first test pattern;

generating with an imaging system image data of the printed first test pattern;

generating confidence level measurements by comparing the generated image data of the printed first test pattern with test pattern data stored in the ink printing system;

generating positional correction data for roll and stitch displacements obtained from the generated image data of the first test pattern in response to the generated confidence level measurements being less than at least one predetermined threshold;

comparing the positional correction data to at least one threshold in a displacement range; and operating at least one printhead actuator in accordance with the positional correction data in response to the positional correction data exceeding the at least one predetermined threshold in the displacement range.

2. The method of claim 1, the first printhead configuration selection further comprising:

selecting two printheads of at least four printheads in a staggered full width array (SFWA) printhead assembly.

3. The method of claim 1, the first printhead configuration selection further comprising:

selecting three of at least four printheads in the SFWA printhead assembly.

4. The method of claim 1, the generation of confidence level measurements further comprising:

generating a roll displacement confidence level measurement for portions of the first test pattern in the generated image data that are used to evaluate roll displacement;

comparing the roll displacement confidence level measurement to a predetermined threshold for roll displacement; and generating the positional correction data for a roll displacement in response to the roll displacement confidence level measurement being less than the predetermined threshold for roll displacement.

5. The method of claim 1, the generation of confidence level measurements further comprising:

generating a confidence level measurement for portions of the first test pattern in the generated image data that are used to evaluate stitch displacement;

comparing the confidence level measurement to a predetermined threshold for stitch displacement; and generating the positional correction data for a stitch displacement in response to the confidence level measurement being less than the predetermined threshold for stitch displacement.

6. The method of claim 4, the generation of confidence level measurements further comprising:

generating a stitch displacement confidence level measurement for portions of the first test pattern in the generated image data that are used to evaluate stitch displacement;

comparing the stitch displacement confidence level measurement to a predetermined threshold for stitch displacement; and generating the positional correction data for a stitch displacement in response to the roll displacement confidence level measurement being less than the predetermined threshold for roll displacement and the stitch displacement confidence level measurement being less than the predetermined threshold for stitch displacement.

7. The method of claim 6 further comprising:

comparing the generated positional correction data for the roll displacement and the positional correction data for the stitch displacement to the at least one predetermined threshold in the displacement range; and operating the at least one printhead actuator in accordance with the positional correction data for the roll and stitch displacements in response to the positional correction data for the roll and stitch displacements being within a predetermined range about the predetermined threshold in the displacement range.

8. The method of claim 7 further comprising:

computing positional correction data for a printhead in the printhead assembly not in the first printhead configuration; and operating at least one other printhead actuator in accordance with the computed positional correction data for the printhead not in the first printhead configuration in response to the computed positional correction data being less than the at least one predetermined threshold in the displacement range by no more than a predetermined amount.

9. The method of claim 7 further comprising:

selecting a second printhead configuration that is different than the first printhead configuration;

generating a second test pattern image with the second printhead configuration in response to the positional correction data for the roll displacement and the positional correction data for the stitch displacement exceeding the at least one predetermined threshold in the displacement range by no more than a predetermined amount.

10. The method of claim 9 further comprising:

generating image data of the second test pattern;

generating positional correction data for roll and stitch displacements obtained from the generated image data of the second test pattern;

comparing the positional correction data generated with reference to the second test pattern to at least one threshold in a second displacement range; and operating at least one printhead actuator in accordance with the positional correction data generated with reference to the second test pattern in response to the positional correction data generated with reference to the second test pattern exceeding at least one predetermined threshold in the second displacement range.

11. A system for evaluating printhead position in an ink printing system comprising:

a plurality of printheads configured to eject ink to form a first test pattern;

an imaging system configured to generate image data of the printed first test pattern;

an image evaluator configured to generate confidence level measurements by comparing the generated image data of the printed first test pattern with test pattern data stored in the ink printing system and to generate positional correction data for roll and stitch displacements detected in the generated image data of the first test pattern in response to the generated confidence level measurements being less than at least one predetermined threshold; and a controller coupled to the plurality of printheads, the image evaluator, and at least one printhead actuator coupled to the plurality of printheads, the controller being configured to operate the at least one printhead actuator in accordance with the positional correction data in response to the positional correction data exceeding at least one predetermined threshold in a displacement range.

12. The system of claim 11, the image evaluator being further configured to select a first printhead configuration that uses two printheads of at least four printheads in the plurality of printheads to form the first test pattern.

13. The system of claim 11, the image evaluator being further configured to select a first printhead configuration that uses three printheads of at least four printheads in the plurality of printheads to form the first test pattern.

14. The system of claim 12, the image evaluator being further configured to compare roll displacement confidence level measurements for portions of the first test pattern used to evaluate roll displacements to a predetermined threshold for roll displacements and to generate the positional correction data for a roll displacement in response to the confidence level measurements being less than the predetermined threshold for the roll displacements.

15. The system of claim 12, the image evaluator being further configured to compare confidence level measurements for portions of the first test pattern used to evaluate stitch displacements to a predetermined threshold for stitch displacements and to generate the positional correction data for a stitch displacement in response to the confidence level value being less than the predetermined threshold for stitch displacements.

16. The system of claim 14, the image evaluator being further configured to compare stitch displacement confidence level measurements for portions of the first test pattern used to evaluate stitch displacement to the predetermined threshold for stitch displacements and to generate the positional correction data for a stitch displacement in response to the roll displacement confidence level measurements being less than the predetermined threshold for roll displacements and the stitch displacement confidence level measurements being less than the predetermined threshold for stitch displacement.

17. The system of claim 16, the image evaluator being further configured to compare positional correction data generated for the roll displacement and positional correction data for the stitch displacement to the at least one predetermined threshold in the displacement range and to operate the at least one printhead actuator in accordance with the positional correction data generated for the roll and stitch displacements in response to the positional correction data generated for the roll and stitch displacements being within a predetermined range about the at least one predetermined threshold in the displacement range.

18. The system of claim 17, the image evaluator being further configured to compute positional correction data for a printhead not in the first printhead configuration and to operate at least one other printhead actuator in accordance with the computed positional correction data generated for the printhead not in the first printhead configuration in response to the computed positional correction data being less than the at least one predetermined threshold in the displacement range by no more than a predetermined amount.

19. The system of claim 18, the image evaluator being further configured to select a second printhead configuration that is different than the first printhead configuration, and to generate a second test pattern in response to the positional correction data generated for the roll and stitch displacements exceeding the at least one predetermined threshold in the displacement range by no more than a predetermined amount.

20. The system of claim 19, the image evaluator being further configured to generate positional correction data for roll and stitch displacements obtained from image data of the second test pattern generated by the imaging system, and to operate at least one other printhead actuator in accordance with the positional correction data generated with reference to the second test pattern in response to the positional correction data generated with reference to the second test pattern being within a predetermined range about the at least one predetermined threshold in the displacement range.

* * * * *